United States Patent [19]

Purviance

[11] 4,050,697

[45] Sept. 27, 1977

[54] GAME AND GAME APPARATUS

[76] Inventor: John R. Purviance, 29530 Highmeadow Road, Farmington Hills, Mich. 48024

[21] Appl. No.: 669,203

[22] Filed: Mar. 22, 1976

[51] Int. Cl.[2] ..... A63F 3/00

[52] U.S. Cl. ..... 273/139; 46/1 C; 209/479; 273/135 AB; 273/140

[58] Field of Search ..... 273/139, 138 R, 138 A, 273/144 B, 144 A, 144 R, 135 AB, 109, 161, 140, 1 L, 1 E, 1 R, 1 M, 145 R, 145 A, 145 B, 145 C, 145 CA, 145 D, 145 E, 135 AD, 137 AE; 46/1 C, 11, 38, 40, 238, 239, 240; 35/19 R; 209/479, 480, 481

[56] References Cited

U.S. PATENT DOCUMENTS

| | | | |
|---|---|---|---|
| 2,525,710 | 10/1950 | Munves | 273/145 D |
| 3,048,075 | 8/1962 | Wright | 273/145 DM X |
| 3,053,538 | 9/1962 | Roca | 273/139 |
| 3,409,302 | 11/1968 | Harrison | 273/139 |
| 3,516,672 | 6/1970 | Maurer | 273/145 D X |
| 3,545,750 | 12/1970 | Stachnik, Sr. | 273/1 E |
| 3,679,208 | 7/1972 | Carrano, Jr. et al. | 273/135 B X |
| 3,811,681 | 5/1974 | Sprouse et al. | 273/139 |
| 3,960,377 | 6/1976 | Doyle | 273/1 R |

FOREIGN PATENT DOCUMENTS

| | | | |
|---|---|---|---|
| 804,044 | 7/1936 | France | 273/140 |
| 1,064,401 | 8/1959 | Germany | 46/1 C |
| 781,092 | 8/1957 | United Kingdom | 46/1 C |

*Primary Examiner*—Richard C. Pinkham
*Assistant Examiner*—Arnold W. Kramer
*Attorney, Agent, or Firm*—Lon H. Romanski

[57] ABSTRACT

A game based on retrieval of randomly positioned game articles employs a housing containing such articles along with a filler material of light weight, such as polystyrene spheres, in order to have the filler material of relatively lesser specific weight and the game articles of relatively greater specific weight. The housing, provided with access apertures, is vibrated as to thereby cause the game articles to be randomly positioned within the housing as well as randomly positioned with respect to such access apertures. The players, following particular related game rules, in turn, employing related retrieval appliances, attempt to retrieve the game articles through such access apertures without benefit of being able to visually locate such game articles which are covered by the filler material.

17 Claims, 28 Drawing Figures

MINING LEASE
FOR DUE CONSIDERATION THE HOLDER OF THIS LEASE HAS EXCLUSIVE RIGHTS TO MINE AND RECOVER ANY AND ALL MINERALS THAT LAY WITHIN THE BOUNDS OF THE LAND DESCRIBED BELOW
SECTION 1-A
Fig. 14
THE HOLDER OF THE LEASE FOR SECTION
1-A -
IS GRANTED PERMISSION TO MINE FOR ONE TIME PERIOD
Fig. 15
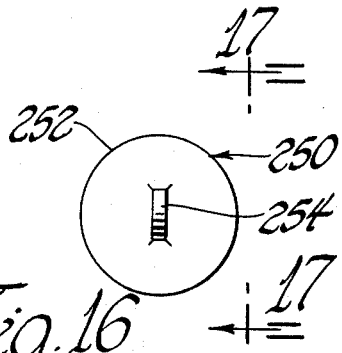
Fig. 16
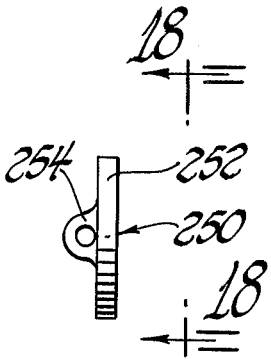
Fig. 17
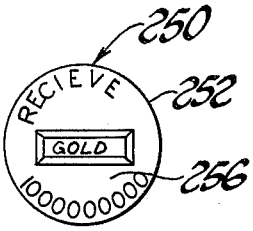
Fig. 18
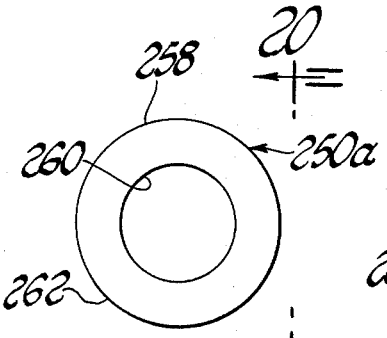
Fig. 19
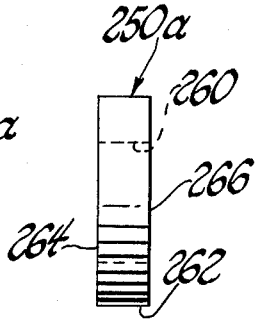
Fig. 20
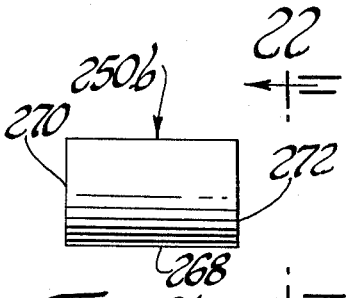
Fig. 21
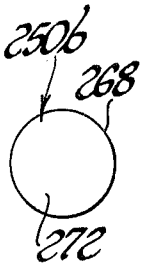
Fig. 22
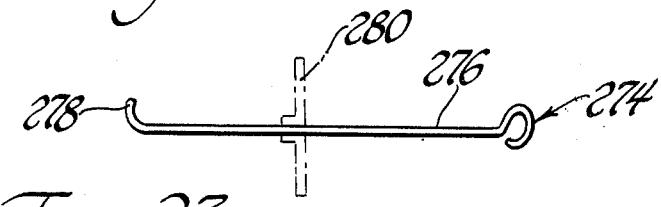
Fig. 23

GAME AND GAME APPARATUS

BACKGROUND OF THE INVENTION

Various games have heretofore been devised and proposed. However, almost without exception, when such prior art games are played often enough the players develop a degree of skill when then becomes a factor in the subsequent playing of such games and what was originally intended to be a game of complete and simply chance becomes a game of individual skill.

The invention as herein disclosed and claimed is primarily directed to overcoming the problem of the prior art, that being skill learning, and providing a game which, for all practical purposes, assures the continuance of simple chance in the playing thereof.

SUMMARY OF THE INVENTION

According to the invention, apparatus for playing the game of the invention comprises a pan-like housing with cover means carried thereby, access aperture means carried by said cover means, game article means situated within said housing and movable with respect thereto, filler means situated within said housing covering said game articles and movable with respect to said game articles and said housing, and means for vibrating said housing as to thereby cause said game articles to translationally move within said housing and become randomly positioned with respect to said access aperture means.

Various general and specific objects and advantages of the invention will become apparent when reference is made to the following detailed description considered in conjunction with the accompanying drawings.

BRIEF DESCRIPTION OF THE DRAWINGS

In the drawings, wherein for purposes of clarity certain details and/or elements may be omitted from one or more views:

FIG. 14 is a view illustrating, typically, a game card employable in the playing of the game of the invention;

FIG. 15 is a view illustrating, typically, another game card employable in the playing of the game of the invention;

FIG. 16 is a top plan view of a retrievable game article;

FIGS. 17 and 18 are views respectively taken on the planes of lines 17—17 and 18—18 of FIGS. 16 and 17 and looking in the direction of the arrows;

FIG. 19 is a top plan view of another configuration of retrievable game article;

FIG. 20 is a view taken generally on the plane of line 20—20 of FIG. 19 and looking in the direction of the arrows;

FIG. 21 is a side view of still another configuration of retrievable game article;

FIG. 22 is a view taken generally on the plane of line 22—22 of FIG. 21 and looking the direction of the arrows;

FIG. 23 is a view of one form of probe employable in the game of the invention;

DETAILED DESCRIPTION OF THE PREFERRED EMBODIMENTS

Figure 1:
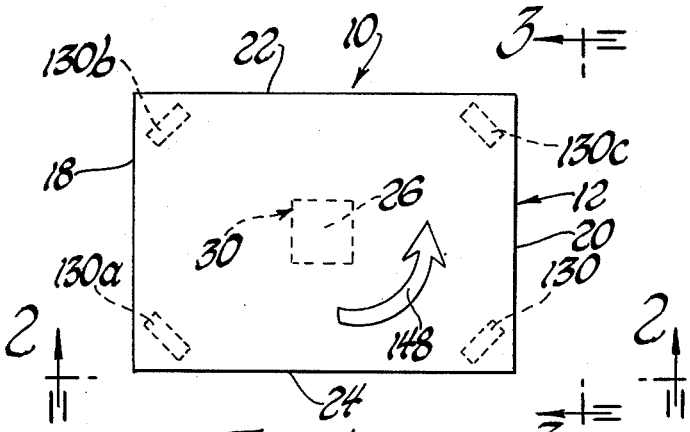
FIG. 1 is a top plan view, in simplified form, of game apparatus embodying the teachings of the invention, with such view being taken generally on the plane of line 1—1 of FIG. 2 and looking in the direction of the arrows.
Figure 3:
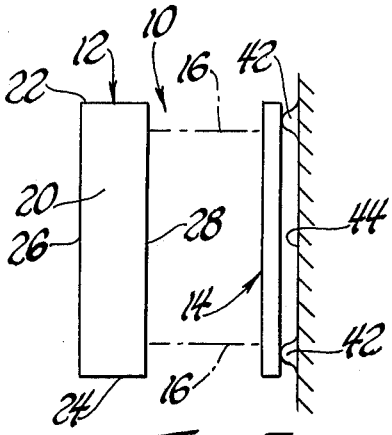
FIG. 3 is a simplified and elevational view, taken generally on the plane of line 3—3 of FIG. 1 and looking in the direction of the arrows.
Figure 2:
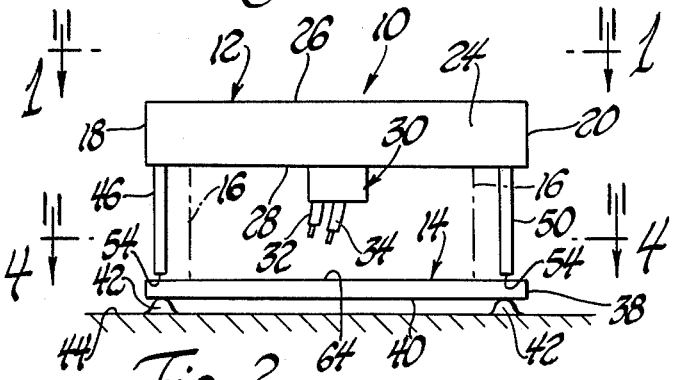
FIG. 2 is simplified side elevational view, taken generally on the plane of line 2—2 of FIG. 1 and looking in the direction of the arrows.

Referring now in greater detail to the drawings, FIGS. 1, 2 and 3 illustrate a game apparatus or structure 10 having an upper disposed portion 12 and lower disposed portion 14 which may be operatively interconnected as by suitable connecting means illustrated as by phantom lines 16. In the preferred embodiment, the upper portion 12 comprises housing means having opposed side walls 18, 20 and 22, 24, cover means 26, and a lower base or bottom wall 28. Related vibration producing means 30 is preferably suitably secured to and carried by and at the underside of bottom wall 28. Although the vibration producing means 30 may actually be any such suitable means, in the preferred embodiment of the apparatus of the invention, the means 30 comprises an electric motor assembly driving suitable associated eccentrically disposed weight means, as is generally well known in the art, to thereby produce a resulting vibratory action. Many such specific vibratory devices are well known in the art and since the invention as disclosed and claimed herein in no way depends upon the specific construction of such vibratory means, any suitable vibration producing means 30, has electrical conductors 32 and 34 which lead as to suitable associated electrical switch means 36.

The lower portion 14 comprises a base-like member 38 which, at its underside 40, is preferably provided with four resilient foot-like members 42. Such members 42 may actually be in the form of suction cups as to thereby not only provide for a clamping effect with respect to a related support surface 44 but also prevent translational motion of the base 38 with respect to such support surface 44. As partially illustrated in FIG. 2 and as subsequently more fully described, the upper housing portion 12 is preferably provided with a plurality of downwardly depending legs 46, 48, 50 and 52 which are respectively connected at their upper ends as to the lower wall 28 of housing 12 and with each of such legs having their respective lower ends, typically illustrated at 54, spaced some suitable distance above base 38. The general location of such legs 46, 48, 50 and 52 with respect to related cooperating elements is further illustrated in FIG. 4 wherein such legs 46, 48, 50 and 52 are shown in phantom line.

Figure 4:
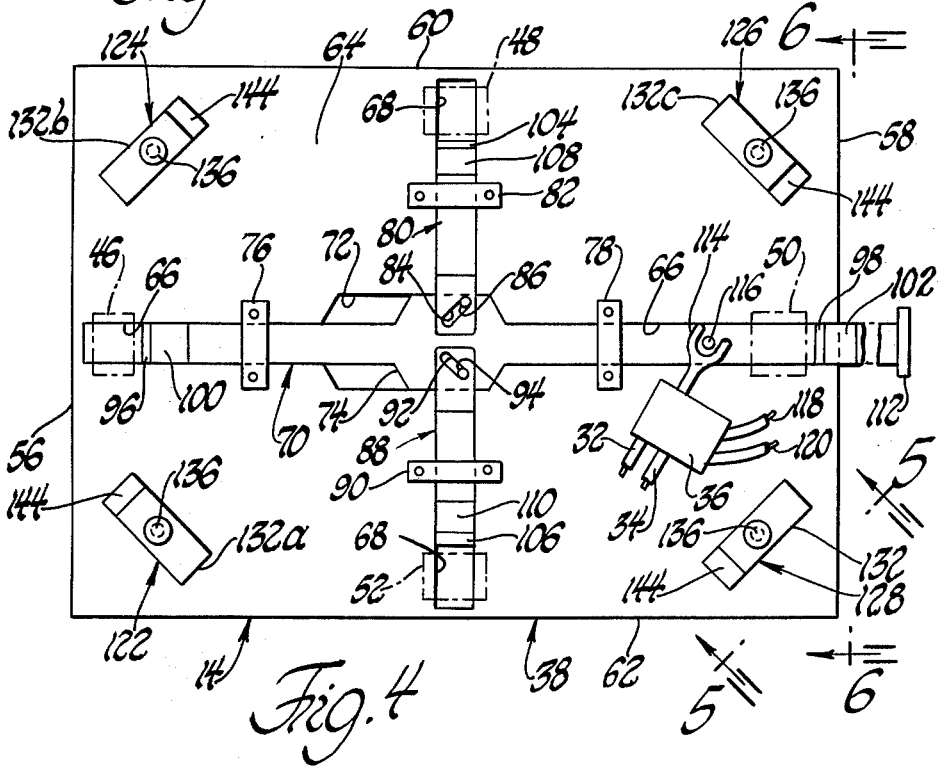
FIG. 4 is an enlarged view taken generally on the plane of line 4—4 of FIG. 2, with certain details shown in phantom line, and looking in the direction of the arrows.
Figure 6:
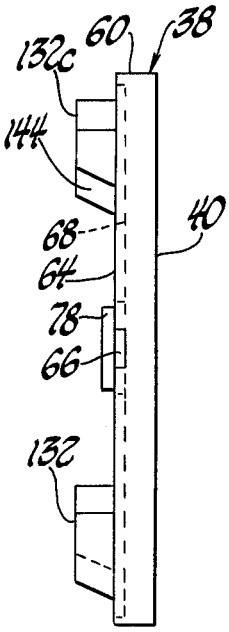
FIG. 6 is an end view, with certain details eliminated, taken generally on the plane of line 6—6 of FIG. 4 and looking in the direction of the arrows.

With particular reference to FIGS. 4 and 6, in the embodiment wherein the housing 12 is rectilinear, the preferred plan view configuration of the base 38 is also rectilinear as to thereby have opposed vertical sides 56, 58 and 60, 62 with a top-most or upper surface 64. A first medially disposed longitudinally extending slot or guide-like recess 66 is formed in the upper surface 64 as to generally intersect with a second transverse medially extending slot or guide-like recess 68 also formed in the upper surface 64.

A first slide member 70 is slidably received within guide recess 66 which, as depicted, may be provided with an intermediately situated enlarged portion 72 as to thereby slidably receive a generally enlarged body portion 74 of slide 70. Retainer members 76 and 78 may be provided and suitably secured to base 38, as generally depicted, in order to maintain slide 70 within guide slot 66.

A second slide member 80 is slidably received within one portion of transverse guide recess or slot 68 and may be slidably maintained therein as by a coacting retainer member 82, functionally similar to 76 or 78, suitably secured to base 38. The inner-most end of slide 80 may be bent generally upwardly as to overlay body portion 74 of slide 70. A cam slot 84, formed generally at the inner-most end of slide 80, cooperatively receives a cam driving member or pin 86 fixedly carried by slide 70 body portion 74.

A third slide member 88 is slidably received within another portion of transverse guide or slot 68 and may be slidably maintained therein as by a coacting retainer member 90, functionally similar to 82, suitably secured to base 38. The inner-most end of slide 88 may be bent generally upwardly as to overlay body portion 74 of slide 70. A cam slot 92, formed generally at the inner-most end of slide 88, cooperatively receives a cam driving member or pin 94 fixedly carried by slide 70 body portion 74.

Longitudinal slide 70 is provided with wedge-like or ramp surfaces 96 and 98 which extend generally upwardly to respective elevated abutment surfaces 102 and 102. Similarly, the outer-most ends of transverse slides 80 and 88 are respectively provided with wedge-like or ramp surfaces 104 and 106 which, in turn, respectively extend generally upwardly to elevated abutment surfaces 108 and 110.

As should be apparent, when handle 112 is engaged and slide 70 is moved toward the left, as viewed in FIG. 4, cam slots 84 and 92 reacting against cam pins 86 and 94, respectively, cause transverse slides 80 and 88 to move outwardly. When the slides 70, 80 and 88 are thusly moved, the wedge or ramp surfaces 96, 104, 98 and 106 begin to pass under respective ends 54 of downwardly depending legs 46, 48, 50 and 52. When slide 70 is to its left-most position and transverse slides 80 and 88 are in their outer-most positions respective abutment surfaces 100, 108, 102 and 110 are positioned under and lockingly engaging the respective ends 54 of legs 46, 48, 50 and 52 thereby effectively precluding the otherwise relatively free vertical movement of housing 12 with respect to base 38.

As generally depicted in FIG. 4, the electric switch 36 may be provided with a yoke-like switching lever 114 which is operatively engaged by an actuating pin 116 carried by slide 70. When the slide 70 is moved to its left-most position as hereinbefore described, pin 116 is effective to cause switch 36 to open the electrical circuit as between conductors 32, 34 and conductors 118 and 120 which lead to a suitable associated source of electrical potential (not shown). However, when slide means 70 is moved to its illustrated rightmost position, pin 116 is effective to cause switch 36 to close the circuit as between conductors 32, 34 and 118, 120 to thereby energize the electric motor means comprising a portion of the vibrator means 30. As should be apparent, when energization of such vibrator means 30 is affected, the respective blocking abutment surfaces 100, 108, 102 and 110 have been withdrawn from under legs 46, 48, 50 and 52 as to thereby permit freedom of motion thereof.

Figure 5:
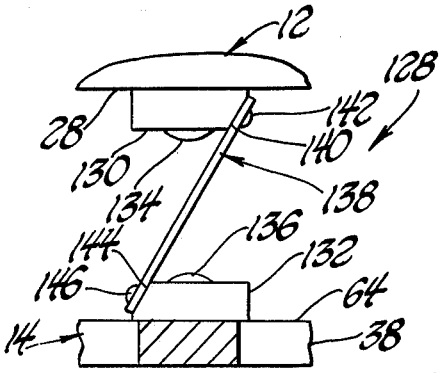
FIG. 5 is a fragmentary view taken generally on the plane of line 5—5 of FIG. 4 and looking in the direction of the arrows.

In view of the disclosure hereinbefore made as well as hereinafter to be presented, it will become apparent that various specific forms of interconnecting means 16 may be employed. However, in the embodiment of FIGS. 1–6, the interconnecting means 16 comprises a plurality of connecting assemblies 122, 124, 126 and 128. As typically illustrated by assembly 128 in FIG. 5, each such connecting assembly 122, 124, 126 and 128 comprises an upper disposed mounting or support member 130 and a lower disposed mounting or support member 132. Upper member 130 may be suitably secured, as by a screw fastener 134 or the like, to the underside of bottom wall 28 of housing 12 while lower member 132 may be suitably secured, as by a screw fastener 136 or the like, to the upper surface 64 of base 38 as to be generally in functional alignment with upper mounting member 130.

A generally flat leaf-type spring 138 extends generally across such mounting members as to have the upper end thereof fixedly secured against an inclined spring mounting surface 140, formed on upper support member 130, by suitable retainer means 142. Similarly, the lower end of spring 138 is fixedly secured against a complementary inclined spring mounting surface 144, formed on lower support member 132, by suitable retainer means 146. The relative locations, at the underside of housing 12, of upper support members 130 for the respective assemblies 122, 124, 126, and 128 are indicated in FIG. 1 at **130*a*, 130*b*, 130*c*, and 130, respectively, while the relative locations at the upper surface of base 38, of lower support members 132 for the respective assemblies 122, 124, 126 and 128 are indicated in FIG. 4 at 132***a*, 132*b*, 132*c* and 132, respectively.

It should be apparent that because of the leaf springs 138 in each of the connecting assemblies 122, 124, 126 and 128, as vibratory action is imparted to the housing means 12, the upper portion or housing will experience upward and downward motion with respect to base 38. However, if, for example, the downward motion is further studied, it will be seen, especially with reference to FIG. 5, that because of the inclined position of spring 138 as upper housing 12 moves downwardly spring 138 undergoes a bowing action causing upper housing 12 to also move (laterally to the right as viewed in FIG. 5) generally counter-clockwise as indicated by arrow 148 of FIG. 1 with respect to base 38. This described action is, of course, reversed as upper housing 12 starts to undergo upward movement with respect to base 38.

Figure 7:
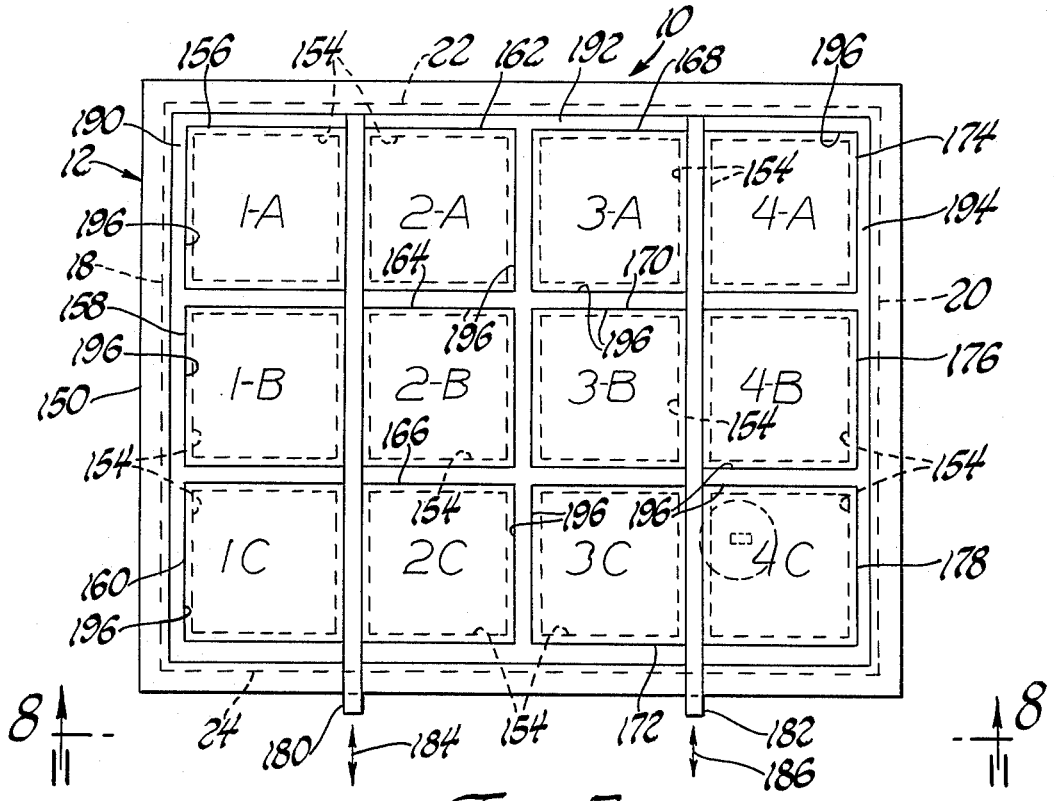
FIG. 7 is a top plan view, similar to that of FIG. 1, but illustrating the top portion thereof in greater detail.

FIG. 7 is a view similar to that of FIG. 1 and illustrating in somewhat greater detail the configuration of the elements generally comprising the top portion of the housing 12. As generally depicted, the upper portion of housing 12 comprises a peripheral frame like portion 150 integrally formed with or carried by and secured to a depending pan or tray-like portion 152 which defines said side walls 18, 20, 22 and 24 as well as bottom wall 28 (also see FIGS. 1 and 8). The top wall means, previously simply identified as at 26, is comprised of a plurality of apertures 154 respectively located as to be situated below openable door members 156, 158, 160, 162, 164, 166, 168, 170, 172, 174, 176 and 178. A plurality of slide-like latching or locking members 180 and 182 are provided for selectively locking and unlocking the doors or hatches 156–178. Locking slides 180 and 182 are adapted for relative sliding action in directions generally indicated by arrows 184 and 186, respectively. Although not essential, nevertheless in the preferred form shown the upper surfaces of the various elements comprising the upper wall means 26 are substantially coplanar and flush with each other.

Figure 9:
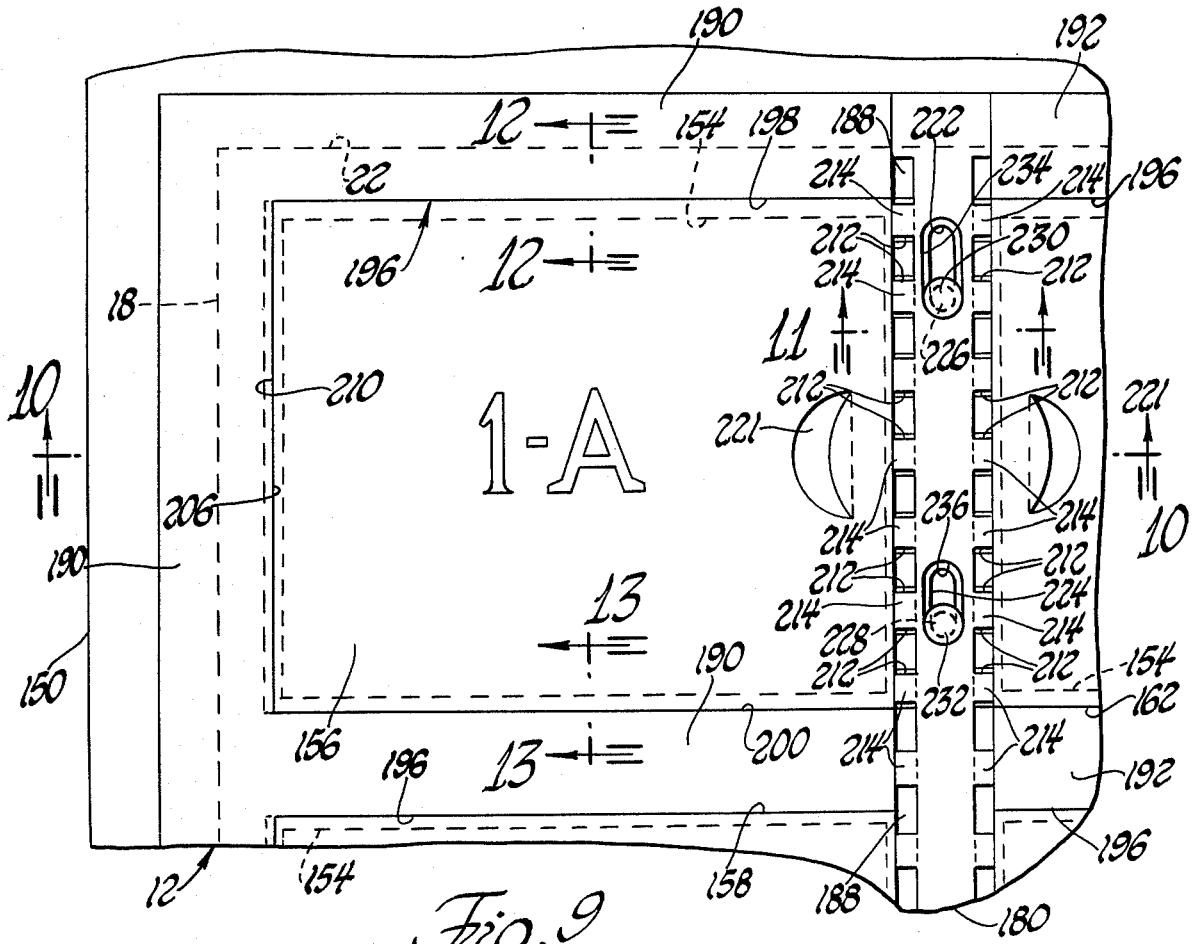
FIG. 9 is an enlarged fragmentary portion of FIG. 7.

FIG. 9 is an enlarged view of a fragmentary portion of the structure shown in FIG. 7. Referring primarily to both FIGS. 9 and 10, the upper wall means of housing 12 comprises an intermediate plate-like body portion 188, bridging walls 18, 20, 22 and 24 as to be generally supported thereby, having said apertures 154 formed therethrough. Situated generally atop such support aperture-defining body 188 are facing-like members 190, 192 and 194 (also illustrated in FIG. 7) which respectively serve to define second openings or apertures 196, in general alignment with respective apertures 154, which serve to generally receive therein respective door members 156–178.

Figure 13:
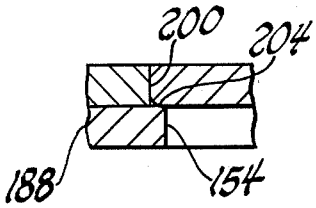
FIG. 13 is a fragmentary cross-sectional view taken generally on the plane of line 13—13 of FIG. 9 and looking in the direction of the arrows.
Figure 12:
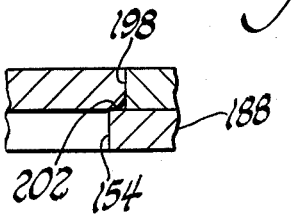
FIG. 12 is a fragmentary cross-sectional view taken generally on the plane of line 12—12 of FIG. 9 and looking in the direction of the arrows.
Figure 11:
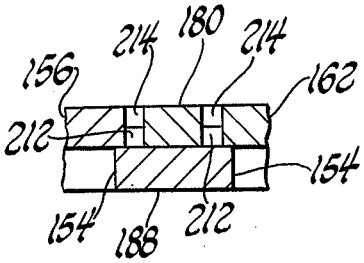
FIG. 11 is a fragmentary cross-sectional view taken on the plane of line 11—11 of FIG. 9 and looking in the direction of the arrows.

As typically shown by FIGS. 12 and 13, the side walls 198 and 200 of each aperture 196 are spaced a distance wider than generally corresponding lower situated side walls of aperture 154 thereby providing respective flange like surface portions 202 and 204. Further, preferably, the side wall 206, opposite to the door locking means, of each aperture 196 is inclined as depicted in FIG. 10 to thereby define a flange portion 208 on lower body 188 and to, in effect, lock against a complementary inclined edge 210 of the related door as illustrated by door 156.

Figure 10:
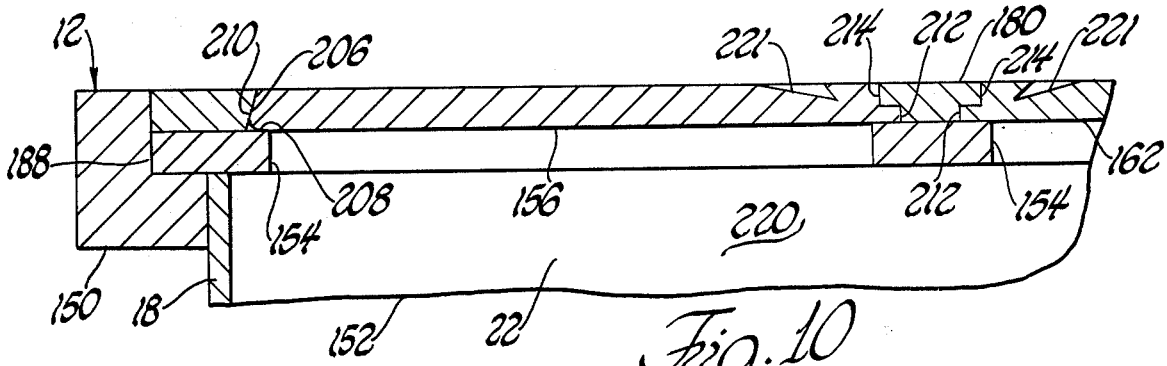
FIG. 10 is a fragmentary cross-sectional view taken generally on the plane of line 10—10 of FIG. 9 and looking in the direction of the arrows.

The edge or side of each door 156–178 opposite to the respective inclined edges 210, is provided with a plurality of spaced tab-like portions 212 which have a step-like configuration when viewed in cross-section as depicted in FIG. 10. As typically illustrated by slide 180, each of the latching slides 180 and 182, is provided with a plurality of second spaced tab-like portions 214 which also have a step-like configuration, when viewed in cross-section as depicted in FIG. 10, as to generally overlay tabs 212. When the respective slides 180 and 182 are positioned as depicted by slide 180 of FIG. 9, the tabs 214 of the slide are juxtaposed to tabs 212 of the door thereby preventing the upward removal of such doors from the containing confines of respective apertures 196. Similarly, the opposite longitudinal side of latch slide member 180 (as well as member 182) is provided with oppositely directed tabs 214 which, at the same time, overlay tabs 212 of door 162 situated on the opposite side of slide 180.

The effective width of the spaces between succeeding tabs 212 is greater than the effective width of the tabs 214 of the respective doors and, similarly, the effective width of the spaces between succeeding tabs 214 is greater than the effective width of the tabs 212. Accordingly, when the latch slide (such as slide 180) is moved longitudinally as to thereby position tabs 214 immediately above the spaces between tabs 212, the doors, generally contiguous to slide 180, such as door 156 may be lifted upwardly and removed from its confining aperture such as 196. Once a door is thusly opened or removed, the respective aperture 154 situated therebelow provides access means for gaining such access to the interior 220 of housing means 12. As generally depicted in FIGS. 9 and 10, each of the doors may be provided with a notch-like portion 221 as to better enable the manual lifting of such door.

Suitable guide and/or retainer means may be provided for each slide 180 and 182 as typically illustrated in FIG. 9. That is, aligned elongated clearance and guide slots 222 and 224 may be formed through the medial body portion of slide 180 as to extend generally longitudinally of such slide. The shank portions 226 and 228 of suitable retainers are respectively closely slidably received through such slots 222 and 224 as to be fixedly anchored within that portion of body 188 situated immediately therebelow while, preferably, the head portions 230 and 232 of such retainers are slidably received within enlarged elongated recess means 234 and 236 of configuration similar to that of respective slots 222 and 224.

Figure 8:
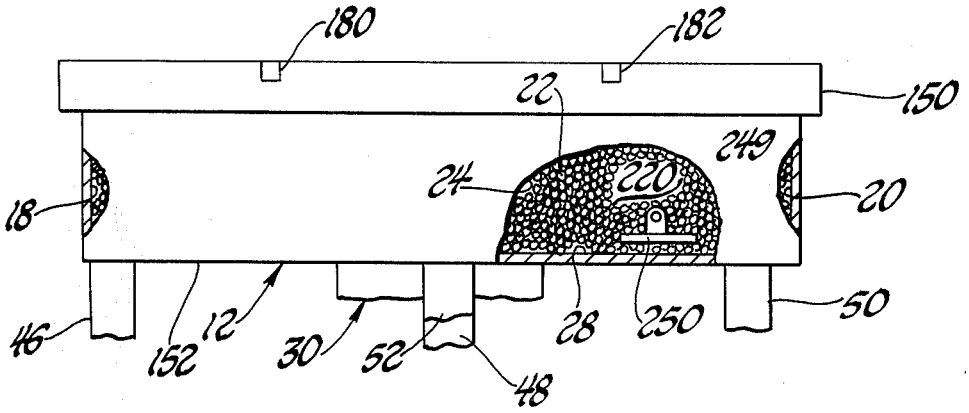
FIG. 8 is a fragmentary side elevational view taken generally on the plane of line 8—8 of FIG. 7 and looking in the direction of the arrows.

As generally best depicted in FIG. 8, the interior chamber 220 of housing 12 is filled to some desired level (even completely filled) with, preferably, a generally fluid particulate 249 of comparatively low specific weight. The height to which chamber 220 is preferably filled may be generally set forth as that height which would assure that any and all of any game articles, such as generally depicted by article 252, would not be visible from above when viewed downwardly through any open aperture 196.

It has been discovered that a filler such as a particulate of polystyrene spheres, with such spheres being generally in the order of one-sixteenth to one-eighth inch in diameter, provides excellent results. During experimentation it has been discovered that when the vibration means 30 is actuated the game articles often tend to position themselves atop such spheres thereby adding another variable factor as to the direction or directions of travel of such game articles as well as the ultimate relative locations attained by such game articles within the housing 12.

During the time that the housing 12 is being vibrated, because of the both vertical and simultaneous lateral motion previously described experienced by the housing, the filler and game articles within chamber 220 tend to move generally in the direction depicted by arrow 148 of FIG. 1. If all of the upper mounting members 130 and all of the lower mounting members 132 are rotated 180° about the centerlines of their respective retainers, the direction of such travel of filler and game articles becomes reversed to that indicated by arrow 148. In this respect, it should be noted that one or more of such connecting assemblies 122, 124, 126 and 128 may be positioned at relative angles differing from the remaining connecting assemblies thereby adding still another variable factor to determining the ultimate relative locations of game articles within chamber 220.

In accordance with the invention, a game, herein called "The Mining Game" may be played with the apparatus of the invention generally as follows:

Object of "The Mining Game"

To see which of a plurality of players can make the most money by investing in mining leases and then mining these leases to try to recover any valuable minerals, in the form of treasure game pieces, they may contain.

Parts of "The Mining Game"

1. Mining Board (housing 12 with upper wall means 26);
2. Mining Machine (suitable probe means for insertion into filler 249 to attempt retrieval of game piece inundated by filler);
3. Timer means (clock);
4. Treasure Pieces (a plurality of game articles which are to player's benefit);
5. Penalty Pieces (a plurality of game articles which are to player's detriment);
6. Mining Leases (cards respectively setting forth a particular mine and identifying such mine as by a particular door 156–178 such as, for example, 1-A, 1-B, 1-C or 2-A etc.; a typical Mining Lease card is illustrated in FIG. 14);
7. Player-Turn Card Deck (a deck of cards with such cards respectively designating a particular mine which is then to be "mined"; a typical Player-Turn Card is illustrated in FIG. 15);
8. Play or Game Money (a plurality of tokens designated as money of varying denominations to be equally divided among the players prior to the start of the playing of the game);

Number of Players

Two or more up to and including twelve players when employing apparatus having twelve doors as disclosed by FIGS. 1–13.

How to Play "The Mining Game"

To start the game, first one of the players is selected to act as Banker. The Banker's first job is to load the mines. The Banker does this by removing the doors 156–178 and dumping all of the plurality of Treasure Pieces and all of the Penalty Pieces into the openings or apertures 154 after which the Banker replaces the doors 156–178 and locks them closed with latch members 180, 182. Next, as by moving handle 112 to the right, the vibration of housing 12 is initiated and permitted to continue until at least all of the Treasure Pieces and Penalty Pieces disappear below the surface of the filler means 249.

The Banker's second general job is to give each player (the Banker also being a player) a money "stake" from the Play Money by equally dividing the Play Money among all such players.

The Banker's third job is to act as auctioneer and auction off all the Mining Leases, one at a time, for the "mines" determined by the respective doors labeled as: 1-A, 1-B etc. The Banker, as a player, is also allowed to bid and may announce his bid as by stating, for example, "The Bank bids —."

The winning bidder of each Mining Lease, using the Play Money, pays the Banker the amount bid and in return receives the card bearing the corresponding "Mining Lease" from the Banker.

The holder of any Mining Lease may sell it at any time after the original auction is completed if such holder and prospective buyer agree on a price therefor.

After all of the Mining Leases have been auctioned-off, the Player-Turn Card Deck is shuffled by the Banker and laid face down. The top Player-Turn Card is turned over, to be face-up, by the Banker. Such Player-Turn Card may state, for example, "The Holder of the Lease for Section 1-A is Granted Permission to Mine for One Time Period." This then permits the player who holds the Mining Lease for the "mine" determined by door 1-A (on the apparatus of FIG. 7 also identified as door 156) to take his turn. The actual "time period" may be any agreed-to span of time such as, for example, one minute.

Mining a Claim

The mining claim or mine, corresponding to the then face-up Player-Turn Card, is opened by removing its cover or door (such as, for example, door 1-A of housing 12) and the player, who is to take his turn, takes his Mining Machine and, for example, places it in juxtaposition to the opening or aperture 154 below such door 1-A, at which time the Timer is started. The player, using only the Mining Machine, probes within the filler material in trying to locate any possible game article within such filler material and below the opened aperture 154. When the player thusly locates any such game article and secures thereto the Mining Machine, the game article is retrieved and removed from the filler and out of the opened aperture 154. The player continues to search and retrieve as many game articles as he can during his "time period" the expiration of which completes that player's turn. During such player's turn, the player may have retrieved one or more game articles which may be either (or a mixture of) one or more Treasure Pieces, respectively having specified values of money thereon which he earns, or one or more Penalty Pieces, respectively having specified values of money thereon which he is to pay.

When a player completes his turn at play, he turns-in all of the game articles, which he retrieved, to the Banker and, in turn, receives Play Money from the Banker in the total amount of the Treasure Pieces thusly retrieved and pays to the Banker, Play Money in the total amount of the Penalty Pieces thusly retrieved. If at this time the player owes the Bank more money than the player has, he must sell such of the Mining Leases that the player may have in order to raise enough cash (Play Money) to pay whatever he owes to the Bank. This must be done before the next player takes his turn. If such a debtor player is unable to raise an amount sufficient to pay his debt to the Bank, such player is declared "Bankrupt," all of any Mining Leases he may have are returned to the Bank and he is out of the remainder of the game.

After the player is settled with the Bank, the player removes the previously turned face-up Player-Turn Card, places it face-down on a discard pile, and turns the next Player-Turn Card face-up to thereby indicate the next "mining" claim (and therefore the player holding the corresponding Mining Lease) to be "mined".

The game continues in the manner described until all of the Mining Leases have been employed.

Obviously, "The Mining Game" as described above may be played with variations as will become apparent to those skilled in the art.

The various game articles, such as the "Treasure Pieces" and "Penalty Pieces" may be of any of a number of suitable configurations. For example, FIGS. 16, 17 and 18 illustrate one type of such game article which has a disc-like main body 252 with an integrally formed eye-like defining portion 254 on one side thereof and a particular value designation, as at 256, on the other side of such body 252. FIGS. 19 and 20 illustrates another possible configuration of game article 250*a* which, as illustrated, comprises a ring-like body 258 having a circular aperture 260 and cylindrical outer surface 262 with generally planar opposed end faces or surfaces 264 and 266. FIGS. 21 and 22 illustrate yet another possible configuration of game article 250*b* which, as illustrated, comprises cylindrical body 268 with opposed generally planar end faces or surfaces 270 and 272.

The game articles 250, 250*a* and 250*b* shown, comprise only a few of the many variations in configurations of such game articles employable in practicing the invention and, it should be apparent, that the practice of the invention if not limited to any specific configuration of game article. Such retrievable game articles may be miniature symbols reflective of the theme of the game being played such as treasure chests, fish, etc., as to be used in games of the invention whose theme would be based on pirate treasures, fishing, etc. Further, such retrievable game articles may be color coded as to thereby designate particular positive or negative game values to be associated therewith. Further, as generally depicted in FIG. 18, such retrievable game articles may have an appropriate legend formed thereon as to thereby recite the particular game value to be assigned that particular retrieved game article as, for example, "receive $10,000" or "pay $10,000", etc.

Various configurations of a "Mining Machine" or probe may be employed. For example, such may take the form of a simple hook-like probe 274, FIG. 23, having a configuration comprising an elongated wire-like body or shank 276 with a simple curled hook portion 278 at the end thereof. Such a probe 274 would be inserted, hook-end-down, into the filler of chamber 220 and the player would then try to both locate and engage the game article or game articles, such as shown for example in FIGS. 16, 17 and 18, and retrieve them by operatively engaging the hook 278 with the eye in portion 254. As generally shown in phantom line, the probe 274 may be provided with a transversely extending plate-like portion 280 which, upon sufficient lowering of the hook portion 278 into chamber 220, will be in a position to axially engage, for example, the structure surrounding the respective apertures 154 as to thereby limit the effective inclination which the player may attempt with the probe 274 and still have the hook portion 278 low enough to operatively engage a retrievable game article.

Figure 24:
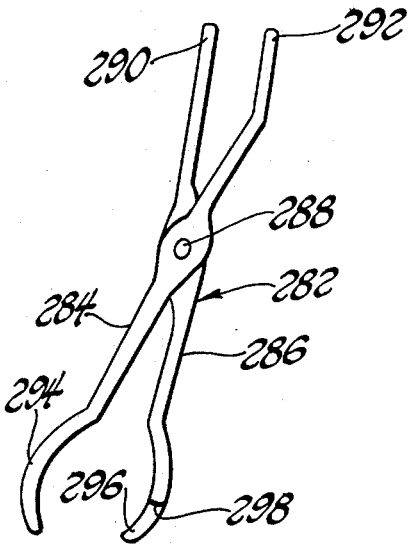
FIG. 24 is a view of another form of probe employable in the game of the invention.

Other forms and configurations of probes are of course possible and many of such variations and configurations will become apparent to those skilled in the art. For example, FIG. 24 illustrates a claw-like scissor action probe 282 having legs 284, 286 which are pivoted with respect to each other as at 288 and which at their upper respective ends have manually engageable portions 290, 292 and at their respective lower ends have curvilinear claw-like means 294, 296 and 298 with means 296 and 298 being spaced from each other. Suitable spring means may be employed, such as a torsion spring carried by and operatively connected to legs 284 and 286, as to thereby normally keep the claw portion 294 open with respect to claw portions 296 and 298 except when portions 290 and 292 are manually pressed toward each other to close these same claw portions.

Figure 26:
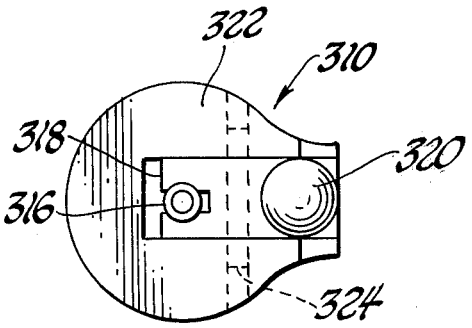
FIG. 26 is a top plan view of a portion of the structure shown in FIG. 25, taken generally on the plane of line 26—26 and looking in the direction of the arrows.
Figure 25:
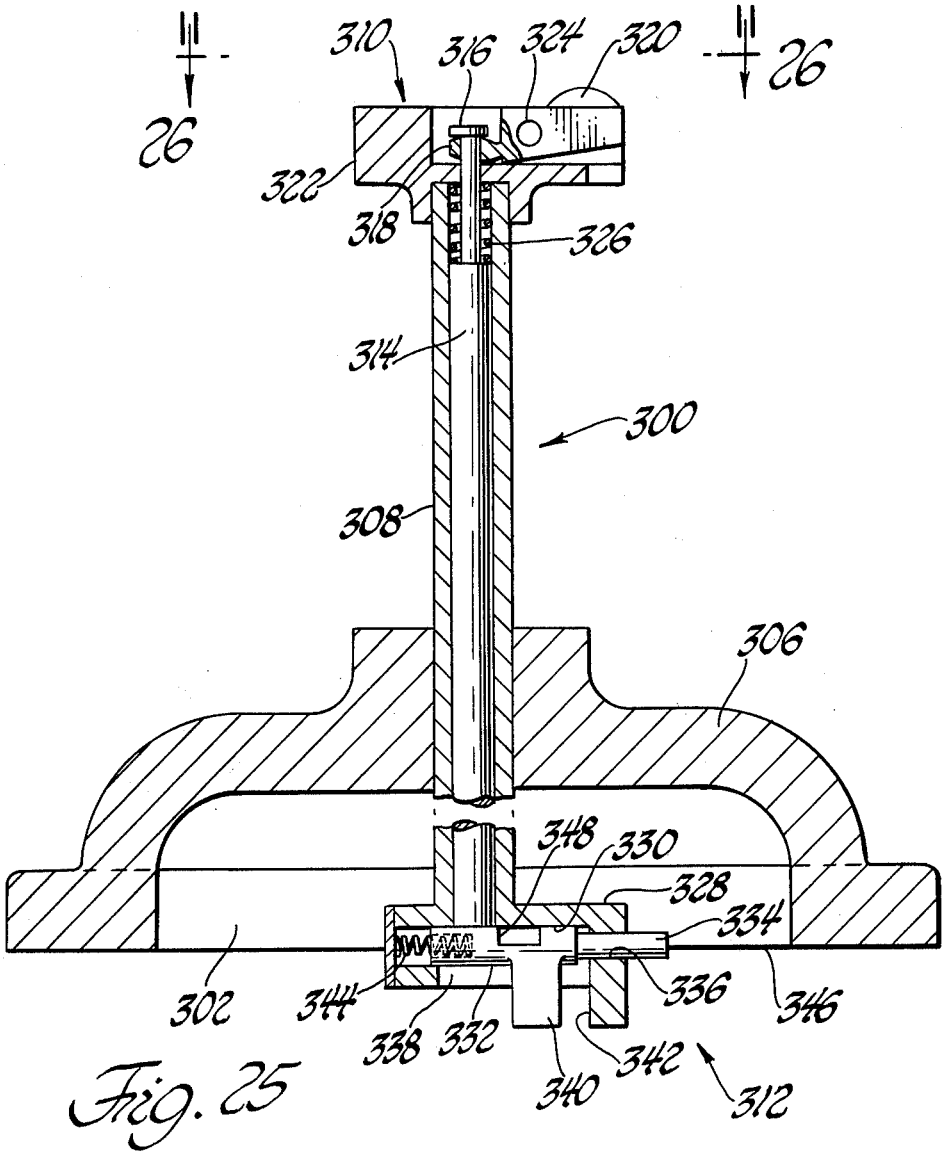
FIG. 25, is a vertically cross-sectional view of still another form of probe employable in the game of the invention.

FIGS. 25 and 26, in enlarged scale, illustrate yet another probe or "Mining Machine" 300 as comprising a generally annular ring-like base or body 302 having a transverse bridge portion 306 supporting a generally vertically extending tubular housing 308 with a trigger assembly 310 atop thereof and a securing or latching assembly 312 at the lower end thereof.

A cylindrical member 314 slidably received within housing 308 has its upper end 316 provided with a generally necked-down portion which is received within a clevis-like portion 318 of a manually actuatable member 320 pivoted within housing portion 322 of trigger assembly 310 as at 324. A spring 326 serves to continually urge member 314 downwardly.

The latching assembly 312 is illustrated as comprising a housing portion 328, carried by housing 308, and defining a cylindrical chamber 330 therein for the reception of a body 332 which has a guide extension 334 slidably received through an aperture 336. A clearance slot 338 enables the downward extension of a movable finger 340, carried by body 332, which operatively cooperates with a fixed depending finger 342 carried by housing portion 328. A spring 344 normally urges body 332 and finger 340 toward the right, as viewed in FIG. 25. Further, the effective width or diameter of base 302 is such as to prevent such base from being inserted through any aperture 154. That is, the player employs the probe 300 by placing base surface 346 on the surface of the structure surrounding and generally defining the aperture 154, and, by feel, attempts to locate the game article by translational movement of the probe 300. At this time, body 332 and finger 340 have been moved to the left against spring 344 as to cause the lower end of member 314 to be seated within cut-out or notch portion 348 of body 332. When the player believes that he has succeeded in positioning the movable finger 340 and fixed finger 342 on opposite sides of a located game article, the player depresses lever 320 thereby lifting member 314 out of notch 348 and permitting spring 344 to move finger 340 toward fixed finger 342 as to thereby, hopefully, secure the game article therebetween, for retrieval.

Figure 27:
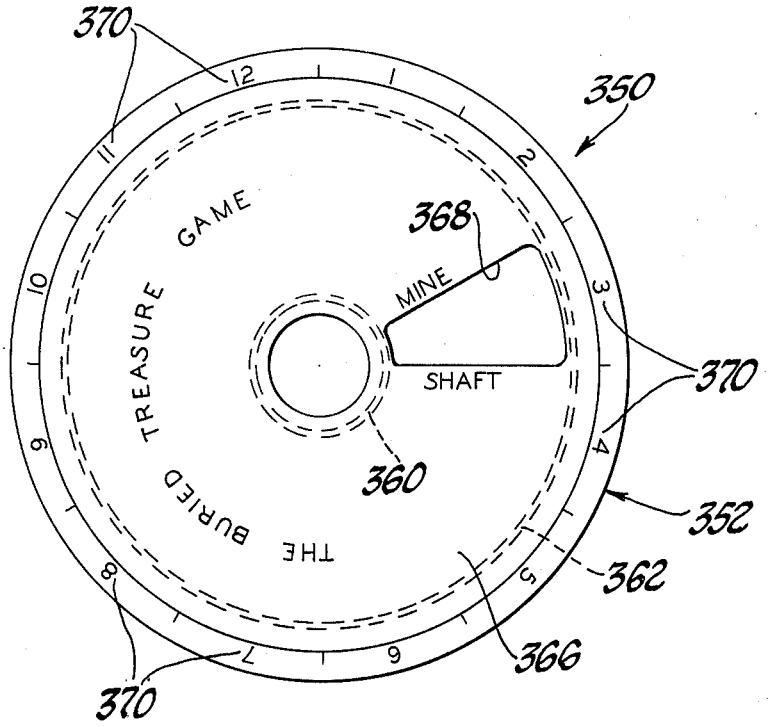
FIG. 27 is a top plan view of another form of apparatus employable in the game of the invention.
Figure 28:
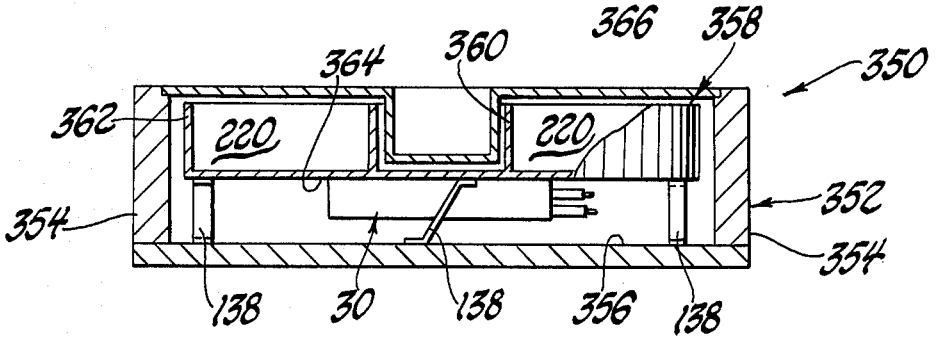
FIG. 28 is a side elevational view, with portions thereof broken away and in cross-hatched, of the apparatus of FIG. 27.

FIGS. 27 and 28 illustrate another general configuration of apparatus employable in the game of the invention. Those elements which are like or similar to those of the preceding figures are identified with like reference numbers.

The apparatus 350 of FIGS. 27 and 28 is illustrated as comprising a cup-like outer housing 352 having a circular vertically extending wall 354 and a generally closed lower base 356 which, in turn, supports a plurality of spring means 138 the upper ends of which are, in turn, operatively connected as to an annular cup-like structure 358 having inner and outer circular side walls 360 and 362 with a common closed transverse base 364 and open at the top end thereof. A disc-like cover member 366 is rotatably seated on and carried by the upper end of housing 352. An aperture 368 formed through cover 366 is variably positionable, as to be selectively angularly positioned juxtaposed to the indicies 370 located generally peripherably thereabout and on housing 352. Such indicies could, for example, correspond to the positions as provided by doors 1-A etc. of FIG. 7. Chamber 220 would, of course, contain the filler 249 and game articles 250. The vibration producing means 30, as generally indicated, would be operatively connected to and carried by the pan structure 358.

It should, of course, be apparent that variations of the invention as herein disclosed are possible. For example the doors 1-A, 1-B, etc., as shown in FIG. 7 need not be totally removable. That is, they may be hinged or otherwise movable as by sliding within guide slots etc. The means for latching doors 1-A, 1-B, etc. need not be the slide type latch means shown, but may be any means suitable to the general overall conformation of the apparatus. As already apparent, the overall configuration of the housing 12 need not be either rectangular or circular and may be combinations and/or variations thereof.

Although only a preferred embodiment and selected modifications of the invention have been disclosed and described, it is apparent that other embodiments and modifications of the invention are possible within the scope of the appended claims.

I claim:

1. A game apparatus for retrieval of randomly positioned game articles, comprising support base means, housing means, connecting means operatively interconnecting said support base means and said housing means, a plurality of retrievable game articles situated within said housing means, a quantity of generally dry and loose particle-like material also situated in said housing means, said material being of a density different from the density of said retrievable game articles, vibration producing means effective for at times inducing a vibratory motion to said housing means as to thereby cause said retrievable game articles and said material to mechanically coact with each other and result in said retrievable game articles being randomly positioned within said housing means and obscurred by said material, wall means generally overlying said housing means as to thereby provide a cover for said retrievable game articles and said material within said housing means, probe-like retrieving means for operatively engaging and retrieving said retrievable game articles from said housing means and from said material, and access aperture means formed through said wall means for enabling the passage therethrough of said retrieving means for at various locations within said housing means attempting to retrieve and for retrieving any of said retrievable game articles within said housing means without benefit of being able to visually locate said retrievable game articles randomly positioned in said housing means.

2. Apparatus according to claim 1 wherein said connecting means operatively interconnects said support base means and said housing means in a manner as to have said housing means relatively movable with respect to said base means, and further comprising selectively engageable locking means for at times preventing relative motion as between said base means and said housing means.

3. Apparatus according to claim 1 wherein said connecting means comprises spring means.

4. Apparatus according to claim 3 wherein said spring means comprises a plurality of spring members laterally spaced from each other and supporting said housing means on said base means.

5. Apparatus according to claim 4 wherein said spring members comprise leaf-type springs inclined with respect to both the vertical and horizontal.

6. Apparatus according to claim 4 wherein said spring members comprise leaf-type springs selectively adjustably positionable with respect to each other and to said housing means as to vary the effective vibratory action produced and imparting to said housing means by said vibration producing means.

7. Apparatus according to claim 1 wherein said vibration producing means comprises electric motor means, and further comprising locking means for at times preventing relative motion as between said base means and said housing means, switch means for energizing and de-energizing said motor means, and control means effective upon actuation thereof in one direction to cause de-energization of said motor means and to actuate said locking means to prevent said relative motion, said control means being effective upon actuation in a direction opposite to said one direction to cause energization of said motor means and unlocking of said locking means to enable said relative motion to occur.

8. Apparatus according to claim 1 wherein said access aperture means comprises a plurality of access apertures, and further comprising cooperating door means carried by said wall means and openable as to give access to said access aperture means.

9. Apparatus according to claim 8 wherein said door means comprises a plurality of door members each separated selectively openable, said plurality of door members being respectively situated in general juxtaposition to said plurality of access apertures.

10. Apparatus according to claim 9 wherein said wall means is of generally rectangular configuration when viewed from above and in plan view, and wherein said plurality of access apertures and said plurality of door members are arranged in a general rectilinear grid pattern thereon when viewed from above and in top plan view.

11. Apparatus according to claim 8 and further comprising latching means for latchingly securing said door means to said wall means.

12. Apparatus according to claim 11 wherein said latching means comprises manually movable slidable means lockingly engageable with said door means.

13. Apparatus according to claim 1 wherein at least a portion of said wall means is generally translationally movable with respect to said housing means.

14. Apparatus according to claim 1 wherein at least a portion of said wall means is angularly rotatable with respect to said housing means.

15. Apparatus according to claim 14 wherein said access aperture means is formed in said portion of said wall means and angularly rotatable therewith with respect to said housing means.

16. A game comprising game board means, container means situated generally below and beneath said game board means, movable retrievable game article means situated within said container means, access aperture means formed through said game board means, generally dry and loose particle-like filler means within said container means obscuring the location of said retrievable game article means within said container means, said filler means being of a density different from the density of said retrievable game article means, and probe means employable by a player of said game for locating said obscured retrievable game article means and to attempt to retrieve said retrievable game article means through said access aperture means.

17. A method of playing a game comprising the steps of placing retrievable game article means within suitable container means provided with access aperture means and having a quantity of generally dry and loose particle-like filler material as to have said retrievable article means loosely confined therein and obscured by said filler material, imparting a vibratory-like motion to said retrievable game article means as to thereby cause random motion of said retrievable game article means with respect to said container means and said access aperture means, and then employing probe means for attempting to locate and retrieve through said access aperture means said retrievable game article means from said container means within a given period of time.

* * * * *